US005968280A

United States Patent [19]

Ronay

[11] Patent Number: 5,968,280

[45] Date of Patent: Oct. 19, 1999

[54] METHOD FOR CLEANING A SURFACE

[75] Inventor: Maria Ronay, Briarcliff Manor, N.Y.

[73] Assignee: International Business Machines Corporation, Armonk, N.Y.

[21] Appl. No.: 08/969,050

[22] Filed: Nov. 12, 1997

[51] Int. Cl.[6] ..... B08B 3/00; B08B 7/00

[52] U.S. Cl. ..... 134/2; 134/1; 134/1.3; 134/3; 134/26; 134/6; 134/28; 134/29

[58] Field of Search ..... 134/1, 1.3, 2, 3, 134/26, 28, 29, 6

[56] References Cited

U.S. PATENT DOCUMENTS

| | | | |
|---|---|---|---|
| 2,884,728 | 5/1959 | Holman | 41/9 |
| 2,895,814 | 7/1959 | Clark | 41/43 |
| 3,579,455 | 5/1971 | Sabatelli et al. . | |
| 3,738,868 | 6/1973 | Lancy | 134/13 |
| 4,129,457 | 12/1978 | Basi | 134/2 |
| 4,569,781 | 2/1986 | Fernholtz et al. | 134/36 X |
| 5,277,715 | 1/1994 | Cathey | 134/2 |
| 5,288,332 | 2/1994 | Pustilinik et al. | 134/27 |
| 5,457,261 | 10/1995 | Brown et al. | 588/1 |
| 5,520,571 | 5/1996 | Brown et al. | 451/88 |
| 5,597,443 | 1/1997 | Hempel | 134/2 |
| 5,662,769 | 9/1997 | Schonauer et al. | 134/2 X |
| 5,806,126 | 9/1998 | De Larious et al. | 134/26 X |

OTHER PUBLICATIONS

Eitoku, Post–CMP Cleaning technology, Semicon Korea 95, pp. 29–36, Jan. 1995.

Nadahara et al, an SPIE abstract of "Process damage in single–wafer cleaning process" published in Proc. SPIE, vol. 3215, pp. 137–143, Sep. 1997.

*Primary Examiner*—Jill Warden
*Assistant Examiner*—Alexander Markoff
*Attorney, Agent, or Firm*—Pollock, Vande Sande & Amernick; Robert M. Trepp

[57] ABSTRACT

A surface such as that of a semiconductor wafer is cleaned by contacting the surface with a cleaning composition containing a polyelectrolyte.

26 Claims, No Drawings

METHOD FOR CLEANING A SURFACE

TECHNICAL FIELD

The present invention is concerned with cleaning a surface. The method of the present invention is particularly applicable for cleaning semiconductive substrates after polishing. The present invention provides for improved cleaning of the desired surfaces. The present invention also provides novel cleaning compositions.

BACKGROUND OF INVENTION

In the microelectronics industry, surfaces that are typically scratch-free are polished for the purpose of planarizing the structure involved and/or removing unwanted material. By way of example, metals such aluminum, copper and tungsten are planarized. These metal surfaces are oxidized so that the polishing abrasive does not produce scratches. Moreover, there is typically a refractory metal liner underneath the aluminum, copper or tungsten, providing good adhesion to the underlying insulator and good contact resistance to the lower level metallizations. The liners can be niobium, tantalum and titanium alone or in combination with their nitrides, or any other refractory metal.

In practice, it is often necessary that a two-step procedure be used to achieve the desired polishing results. A primary polish is used to remove large amounts of the primary material and then a secondary polish for removing a different underlying or liner material. By way of example, the slurries typically contain an abrasive particle such as alumina, silica, ceria, zirconia, or titanium dioxide, along with an oxidizing agent such as ferric nitrate, potassium iodate, ammonium cerium nitrate, potassium ferricyanide, silver nitrate, sodium hypochlorite, potassium perchlorate, potassium permangenate or hydrogen peroxide. The primary and secondary slurries differ both in the kind of abrasive applied and in their chemistry. For instance for metal polish, typically the primary slurry applies alumina abrasive and has an acidic pH, while the secondary slurry applies silica abrasive and has a more neutral pH.

After polishing, it is necessary to clean the polished surface to remove the polishing slurry and polishing debris with a minimum of chemical or mechanical surface damage.

A widely used wafer cleaning method involves mechanical removal whereby the wafers after polishing are passed through one or two pairs of brush-cleaners that are wetted with deionized water. This technique, however, leaves the wafers and the brushes with a relatively high content of polishing debris particles referred to as particle count. This results in reducing the wafer yield and/or limiting the brush life, which is a relatively expensive item.

SUMMARY OF INVENTION

The present invention provides a process for cleaning a surface that addresses above-discussed problems in the prior art. In particular, the present invention provides an enhanced cleaning process especially for post-chemical/mechanical polish wafer cleaning. In addition, the present invention provides the enhanced cleaning without causing damage to the surface such as undesirable etching or corroding of the surfaces treated.

In particular, the method of the present invention comprises contacting the surface to be cleaned with a composition containing a polyelectrolyte. The polyelectrolyte is present in an amount effective for removing contaminant from the surface.

In addition, the present invention is concerned with compositions for cleaning a surface which comprises a polyelectrolyte in an amount effective for removing contaminant from the surface and an inorganic electrolyte. The inorganic electrolyte may be in an amount of about 0.02 to about 2% by weight based upon the total weight of the composition.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

BEST AND VARIOUS MODES FOR CARRYING OUT INVENTION

According to the method of the present invention, a surface to be cleaned is contacted with a composition containing a polyelectrolyte. The polyelectrolyte adsorbs typically by chemisorption, i.e. electron transfer, on the particle surfaces of the material to be removed as well as on the substrate surface such as on the wafer surface. This enhances electrostatic repulsion between the particles to be removed such as polishing debris particles and the surface of the substrate. The preferred polyelectrolyte employed in accordance with the present invention are relatively low molecular weight, typically less than about 100,000, and include a charge-producing functional group along with segments of the polymer chain extending into the solvent, which increases repulsion by adding a "steric repulsion" to the electrostatic repulsion and further prevents collision with other particles. The molecular weight of the polyelectrolytes are preferably about 500 to about 10,000, a typical example of which being about 2,000.

The term "polyelectrolyte" refers to a substance that contains polyions, which are macro-molecules having a large number of ionizable groups. To preserve the electroneutrality of the polyelectrolyte substance, the polyion charges must be compensated by counterions, typically ions of low molecular weight such as $H^+$, $Na^+$, $K^+$, or $NH_4^+$. Unlike most uncharged polymers, polyelectrolytes usually are soluble in polar solvents such as water. With regard to their protonation equilibria in aqueous solution, they can be classified as polyacids, polybases, or, if both acidic and basic groups are present, as polyampholytes. The polyelectrolytes can contain acidic groups such as carboxyl groups, for example in poly(acrylic acid), poly(methacrylic acid), poly (methyl methacrylic acid), poly(maleic acid), or saturated or unsaturated poly(carboxylic acids). Also, phosphoric acid and/or sulfonic acid groups can be incorporated into a polymer and may act as acidic functional groups.

Also, the polyelectrolyte can contain basic groups including nitrogen-containing groups, such as polymers with amino, amide, imide, vinyl pyridine, piperidine and piperazine derivatives.

The following Table 1 illustrates some ionizable chain molecules suitable for the present invention.

TABLE 1

Examples of some ionizable chain molecules used in the cleaning compositions:

| | |
|---|---|
| poly (acrylic acid) | $[-CH_2-CH(COOH)-]_n$ |
| poly (methacrylic acid) | $[-CH_2-C(CH_3)(COOH)-]_n$ |
| poly (vinylsulfonic acid) | $[-CH_2-CH(SO_3H)-]_n$ |
| poly (acrylic acid-co-maleic acid) | $[-CH_2-CH(COOH)-CH(COOH)-CH(COOH)-]_n$ |
| poly (vinylamine) | $[-CH_2-CH(NH_2)-]_n$ |
| poly (ethylenimine) | $[-CH_2-CH_2-N(H)-]_n$ |
| poly (4-vinyl pyridine) | $[-CH_2-CH-C_5H_4N]_n$ |
| salt or ester of poly(acrylic acid) | $[-CH_2-CH(COY)-]_n$ |
| salt or ester of poly(methacrylic acid) | $[-CH_2-C(CH_3)(COY)-]_n$ |

wherein Y is $OC_1$–$C_4$ alkyl, $OH^-$, alkali metal ion such as $Na^+$ $K^+$, and $NH_4^+$ ion.

In particular, in the polyelectrolyte additives n, the repeat number of the monomer unit, preferably should be in the range of 5–200, bringing the preferred molecular weight regime of polyelectrolytes between about 500 and 10,000.

The polyelectrolytes are employed in amounts effective to remove the contaminants from the substrate to be cleaned and typically in amounts of about 0.02 percent by weight to about 2 percent by weight and more typically about 0.05 percent by weight to about 1 percent by weight, based upon the weight of the cleaning composition. For the polyions to have a high binding energy to the surface of the abrasive particles, it is desirable that the polyions have a high charge density. The addition of inorganic electrolytes such as acids, salts and bases increases the strength of a weak polyelectrolyte and thus its adsorption on the abrasive particle. The concentration of the inorganic additives may be in the range of about 0.02% to about 2.0% by weight.

The compositions employed are preferably aqueous composition. Other types of suitable compositions include those using as the diluent organic solvents such as propylene carbonate and mono and polyhydric alcohols such as methanol, ethanol, ethylene glycol and glycerol. of course, mixtures of these diluents as well as mixtures with water can be used when desired.

The surfaces preferably cleaned according to the present invention are surfaces employed in producing semiconductor devices such as silicon wafers.

In addition, the present invention is applicable for removing polishing debris caused by a wide variety of chemical mechanical polishing processes, including those employed polishing compositions containing abrasive particles including alumina, silica, zirconia and ceria and preferably alumina-based and silica-based polishing slurries. Moreover, the cleaning procedure of the present invention is applicable as the cleaning process after polishing a wide variety of materials including metals such as aluminum, chromiun, tungsten, copper, titanium, niobium, tantalum, alloys thereof and their nitrides; silicon dioxide; silicon nitride, diamond-like carbon and single and polycrystalline silicon.

In addition, according to preferred aspects of the present invention, after treatment with the cleaning composition, the surface being treated is subject to a deionized water wash to remove any residual of the cleaning composition.

The method employed to contact the surface with the cleaning composition also includes a wide variety of techniques. For example, the surface to be treated can be transported to the first pair of typical or conventional brush-cleaners with the cleaning composition of the present invention being applied to the surface during contact with the first pair of brush cleaners or to the brushes themselves. This can be followed by a deionized water wash of the surface in contact with a second pair of brush cleaners. These are typically in the form of roller sponge brushes. Instead of roller sponge brushes, other known brush techniques such as pencil sponge cleaner can be used.

In another method, a brushless cleaning process such as using a megasonic tank cleaning unit can be employed whereby the surfaces to be cleaned are placed in a megasonic tank unit along with the cleaning compositions of the present invention. This results in adequate cleaning of the surfaces without causing damage to the surfaces. On the other hand, prior attempts to use such a technique have resulted in adding etchants to the cleaning fluid because the mechanical action in the megasonic tank was not sufficient to clean the surfaces. However, the presence of the etchants resulted in etching the wafer lying beneath the particles to be removed, thereby damaging the wafer. Accordingly, such technique was not possible with prior art cleaning compositions.

The cleaning compositions of the present invention can be employed in immersion cleaning, spray cleaning and various forms of jet cleaning. A novel method of wafer cleaning applies a "cavitation jet" (Ebara company). Here in the center of a low frequency jet a high frequency jet is built in, and this dual jet is directed toward the wafer. This process has an extremely small process window, because the oxide areas on the wafer charge up which ultimately leads to erosion damage. If, according to this invention, the cavitation jet is made of a polyelectrolyte solution instead of deionized water, the cleaning action of the dispersant permits the use of milder frequency conditions. In addition to this, the polyelectrolyte is conducting which prevents the charging of the oxide. These two factors result in reduced cavitation damage, and make the use of this novel cleaning technique viable.

In yet another scheme, the polyelectrolyte containing cleaning solution can be applied instead of deionized water to the rinse cycle of any polishing process performed on the rotating table of the polishing tool.

It is important to note that the polyelectrolytes enhance the cleaning action of every cleaning scheme without etching or corroding the wafers.

While the current invention is aimed primarily towards the microelectronics industry, where cleaning of wafers is of utmost importance, the polyelectrolyte-containing cleaning fluids are equally suitable for the removal of fine particles, polishing and buffing residues, residues resulting from magnetic particle inspection or any other non-oily impurities utilizing immersion cleaning, spray cleaning, ultrasonic cleaning, wet cloth cleaning or damp cloth cleaning for the following applications:

powder metallurgy parts
cast parts
machined parts
sheet metal parts
recording heads
flat panel displays
optics industry such as lenses, particularly contact lens and surface preparation for coating, painting and electroplating.

The surface to be cleaned of contaminant or particles may be planar, non-planar, or patterned with features, some being less than 1 micron and may include aluminum, chromium, tungsten, copper, titanium, niobium, tantalum, silver, alloys thereof, their nitrides, silicon dioxide, silicon nitride, diamond-like carbon, single and polycrystalline silicon, polymer, magnetic alloy, iron and steel.

The following non-limiting examples are presented to further illustrate the present invention.

EXAMPLE 1

24 test silicon wafers patterned with aluminum and $SiO_2$ with a liner there between are subjected to a two-step chemical-mechanical polishing process. In the first step, the slurry consisted of 1 weight % colloidal alumina and an oxidant at pH=2.0, while in the second step the slurry consisted of 10 weight % colloidal silica at a mildly alkaline pH. The silicon wafers patterned with aluminum and $SiO_2$ with a liner there between are then conveyed to a brush-cleaner containing two pairs of brushes that are wetted by deionized water. After cleaning the aluminum wafers, a silicon monitor wafer is conveyed through the brush cleaner. The FM particle count taken on a tencor surfscan showed an extremely high particle count of 500.

EXAMPLE 2

Example 1 is repeated except that the cleaning composition at the first pair of brushes is an aqueous solution of 0.065 weight percent of poly(acrylic acid) having a molecular weight of 2000. After cleaning the silicon wafers patterned with aluminum and $SiO_2$ with a liner there between, a silicon monitor wafer was passed through the brush cleaner. The FM particle count taken on a tencor surfscan showed a particle count of only 20.

A comparison of Example 2 with comparison Example 1 illustrates that the present invention reduced the particle count by a factor of 25, illustrating the significantly improved results achieved by the present invention.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A method for cleaning a substrate which comprises contacting said substrate with a composition containing a polyelectrolyte in amount effective for removing contaminants from said substrate wherein said substrate have been polished by chemical-mechanical polishing; said contaminants comprising polishing debris or residual polishing slurry or mixtures thereof; and said polyelectrolyte being selected from the group consisting of poly(acrylic acid), poly(methacrylic acid), poly(maleic acid), poly(vinyl sulfonic acid), poly(acrylic acid-co-maleic acid), poly (vinylamine), poly(ethylene imine), poly(y-vinyl pyridine); salts thereof and esters thereof.

2. The method of claim 1 wherein said polyelectrolyte has a molecular weight of less than 100,000.

3. The method of claim 1 wherein said polyelectrolyte has a molecular weight of about 500 to about 10,000.

4. The method of claim 1 wherein the amount of said polyelectrolyte is about 0.02 weight percent to about 2 weight percent based upon the weight of the cleaning composition.

5. The method of claim 1 wherein said polyelectrolyte has a molecular weight of about 1000 to about 5000.

6. The method of claim 1 wherein said polyelectrolyte comprises acidic groups.

7. The method of claim 1 wherein said polyelectrolyte comprises basic groups.

8. The method of claim 1 wherein said polyelectrolyte is a polyampholyte.

9. The method of claim 1 wherein said polyelectrolyte is selected from the group consisting of poly(acrylic acid), poly(methacrylic acid), poly(maleic acid), salts thereof and esters thereof.

10. The method of claim 1 wherein said polyelectrolyte is poly(acrylic acid).

11. The method of claim 1 wherein said composition further comprises an inorganic electrolyte in an amount of about 0.02 weight percent to about 2 weight percent.

12. The method of claim 11 wherein said inorganic electrolyte is an acid, salt or base.

13. The method of claim 1 wherein said composition is an aqueous composition.

14. The method of claim 1 wherein said composition contains an organic solvent.

15. The method of claim 14 wherein said composition further contains water.

16. The method of claim 1 wherein contaminants removed from said substrate are chemical-mechanical polishing debris particles from polishing containing abrasive particles selected from the group consisting of alumina, silica, zirconia, and ceria.

17. The method of claim 1 which further includes contacting said substrate with deionized water for removing said composition from said substrate.

18. The method of claim 1 wherein said substrate is contacted with brush-cleaners along with said composition.

19. The method of claim 18 wherein said brush-cleaners are sponge brushes.

20. The method of claim 1 wherein said substrate is contacted with a pencil sponge along with said composition.

21. The method of claim 1 wherein said contact with said composition comprises placing said substrate in a megasonic tank containing said composition.

22. The method of claim 1 wherein contact of said substrate with said composition comprises a jet cleaning technique.

23. The method of claim 22 wherein said jet cleaning technique employs a cavitation jet.

24. The method of claim 1 wherein the said composition is applied in a "rinse" cycle of the chemical-mechanical polishing process in place of deionized water.

25. The method of claim 1 wherein contaminant removed is polishing debris from polishing a material selected from the group consisting of aluminum, tungsten, copper, titanium, niobium, tantalum, silver, alloys thereof, nitrides of aluminum, tungsten, copper, titanium, niobium, tantalum, and silver, silicon dioxide, silicon nitride diamond-like carbon, single and polycrystalline silicon, polymer, magnetic alloy, iron and steel.

26. The method of claim 1 wherein the amount of the polyelectrolyte is about 0.02 weight percent to about 2 weight percent based upon the weight of the composition.

* * * * *